United States Patent [19]

Rode

[11] Patent Number: 5,067,563

[45] Date of Patent: Nov. 26, 1991

[54] SPILLPROOF OIL WELL SEAL

[76] Inventor: Walter H. Rode, Calle B, Q, Los Mangos, Urb. Los Marios, Caracas, Venezuela

[21] Appl. No.: 665,076

[22] Filed: Mar. 6, 1991

[51] Int. Cl.[5] ..... E21B 33/03

[52] U.S. Cl. ..... 166/84

[58] Field of Search ..... 166/75.1, 84, 86, 88, 166/113, 379; 277/2, 18, 20, 28, 59, 72 R

[56] References Cited

U.S. PATENT DOCUMENTS

| | | | |
|---|---|---|---|
| 2,674,474 | 4/1954 | Lister | 166/84 |
| 3,967,678 | 7/1976 | Blackwell | 166/84 X |
| 4,071,085 | 1/1978 | Grable et al. | 166/84 |
| 4,326,584 | 4/1982 | Watkins | 166/84 X |
| 4,390,063 | 6/1983 | Wells, Jr. | 166/84 |
| 4,655,284 | 4/1987 | McIlvride | 166/84 |
| 4,917,190 | 4/1990 | Coppedee | 166/84 X |

*Primary Examiner*—Thuy M. Bui

*Attorney, Agent, or Firm*—Sixbey, Friedman, Leedom & Ferguson

[57] ABSTRACT

A spillproof sealing system for hydrocarbon-producing wells which produce gas and crude oil is provided. The sealing system includes a liquid sealing element which cooperates with a gas sealing component positioned about the well polished rod to seal the well against crude oil leaks while simultaneously providing sufficient oil to lubricate and cool the polished rod during well operation. A liquid/gas separation chamber is provided to receive gas from the well that has been pressurized by a compressor to seal the gas sealing component. Excess gas and crude oil are returned to the well production line. Liquid level sensing and switch means are further provided to automatically shut down the well motor if the crude oil level in the liquid/gas separation chamber exceeds an established minimum level.

15 Claims, 3 Drawing Sheets

SPILLPROOF OIL WELL SEAL

TECHNICAL FIELD

The present invention relates generally to sealing systems for hydrocarbon-producing wells and specifically to a spillproof sealing system for an oil well.

BACKGROUND ART

The extraction of liquid and gas hydrocarbons from subterranean deposits is performed by well drilling and pumping apparatus that has not changed substantially over the years. This apparatus usually includes a well casing and a well tubing that extends down inside the casing to a point below the normal level of oil in the casing. A reciprocating motor driven pump is usually provided inside the tubing. The pump has a plunger which is connected to a string of sucker rods that extends up through the tubing to connect with a polished rod which extends out of the ground and is attached to conventional oil well pumping structure such as a horse head walking beam and counterweights. The action of the reciprocating pump and the horse head walking beam cause the sucker rods and polished rod to lift a column of oil from a subterranean pool or deposit at the bottom of the well casing to the surface. A stuffing box or similar structure is typically located around the polished rod and contains packing or sealing material to prevent oil from being pumped out of the well casing and into the surrounding environment as the polished rod and sucker rods reciprocate to pump oil out of the well. Hydrocarbon-producing wells also include some type of delivery pipe or production line through which crude oil and well gas can be pumped to storage tanks.

The stuffing box or like structure that surrounds the polished rod usually contains one or more packing glands or sealing elements. The packing glands perform a sealing function and prevent oil from leaking out of the well around the polished rod. The packing glands and sealing materials available for this purpose are not indestructible and eventually are worn by chemical or physical contaminants, such as sand, and by the constant reciprocating motion of the polished rod. As a result, these structures will ultimately fail unless they are replaced first.

If a packing gland or sealing element fails, crude oil from the well may simply leak or spill around the polished rod or it may be forcibly blown out of the well. If an oil leak around the polished rod is not stopped promptly, the amount of leaking oil will quickly increase with the reciprocating action of the polished rod, especially if the polished rod is worn. As the leakage increases, the likelihood of damage to the polished rod and its associated structures also increases. Additionally, pumping action may also be affected, with the result that the effectiveness of the well in bringing oil to the surface is greatly decreased. If the leaking oil forcibly blows out of the well, damage to the surrounding environment could result.

In many oil fields the wells are spaced far apart over a large area and are not inspected frequently. Consequently, a failure of the polished rod sealing structures on one of these wells may not be discovered and corrected for some time after the leak actually occurred. If the sealing structures have failed to the point where oil is blown out of well, moreover, serious environmental damage could occur before it is discovered. Many jurisdictions impose heavy fines on oil well operators when the atmosphere, ground and/or water supply are polluted by hydrocarbon-producing well contaminants. Consequently, manual oil well inspections must be conducted at relatively short intervals to detect leaks as soon as possible after they begin.

Oil from the well may be used to lubricate the polished rod as it reciprocates axially upward and downward through the stuffing box and packing or sealing materials during well operation. If the flow of oil to the polished rod stops while the pump mechanism driving the polished rod is still operating, the polished rod will not be sufficiently lubricated. Unless the pump is stopped immediately, the polished rod and surrounding packing materials will be seriously damaged and require replacement. When oil wells are located far apart over a large area, the manual inspections typically performed by a single operator may not detect an oil flow stoppage early enough to prevent the substantial damage to the polished rod or associated structures which occurs when the well operates with too little or no lubrication of the polished rod.

The prior art has proposed various solutions to the aforementioned problems. U.S. Pat. No. 3,967,678 to Blackwell, for example, discloses a stuffing box control system for sensing the leakage of oil past the polished rod seals. In the event a leak is detected, it is corrected by adjusting the seals with a pressurized piston system. A pressure switching box including switches actuated by the hydrostatic head of the well fluid in a chamber separate from the polished rod and sealing structure is provided to control oil flow conditions in the stuffing box. However, the system described in this patent still requires an operator to monitor the piston system and correct any problems manually.

In U.S. Pat. No. 3,580,586 Burns discloses an inflatable packing glad to prevent the leakage of crude oil around the well polished rod which automatically maintains a predetermined optimum pressure of a packing member against the polished rod. This pressure, which may be amplified by well pressure, is exerted on the outer periphery of the packing member so that wear on the inner peripheral portion of the packing member in contact with the polished rod will not result in oil leaking around the polished rod. While this system does minimize the leakage of crude oil around the polished rod by maintaining a seal when the packing member is worn, it also has its limitations. In particular, adequate lubrication of the polished rod may not always be maintained.

U.S. Pat. No. 4,917,190 to Coppedge and U.S. Pat. No. 2,674,474 to Lister disclose, respectively, a system for containing an oil well blowout in the event of a failure of the packing gland and a system for maintaining a supply of lubrication fluid for the polished rod if the flow of oil from the well stops while the pump is still operating. The Coppedge system, however, still relies on manual inspection to ensure that it is functioning properly. The Lister system is limited to supplying lubricant to the polished rod and does not address the problem of oil leakage around the polished rod.

The prior art, therefore, has failed to disclose a sealing system for a hydrocarbon-producing well which simultaneously prevents the leakage of crude oil around the polished rod while providing sufficient oil to lubricate the polished rod during well operation. The prior art has further failed to provide a sealing system for a hydrocarbon-producing well which employs gas from the well casing to perform the primary sealing function.

SUMMARY OF THE INVENTION

It is a primary object of the present invention, therefore, to provide a hydrocarbon-producing well sealing system which overcomes the disadvantages of the prior art and effectively seals the well against crude oil leakage while providing adequate lubrication to the polished rod.

It is another object of the present invention to provide an oil well sealing system that prevents the spillage of crude oil and contamination of the environment surrounding the well.

It is yet another object of the present invention to provide a sealing system for an oil well that provides a controlled leakage of oil to lubricate and cool the well polished rod.

It is still another object of the present invention to provide a sealing system for a hydrocarbon-producing well which employs well gas to perform the primary well sealing function.

It is a further object of the present invention to provide a sealing system for an oil well which uses well gas to seal the well against oil spills and then recovers this well gas for subsequent reuse.

It is yet a further object of the present invention to provide a sealing system for an oil well which substantially increases the production of the well.

The aforesaid objects are accomplished by providing a sealing system for a hydrocarbon-producing well that prevents the leakage of crude oil and contamination of the environment surrounding the well. The oil well sealing system of the present invention includes a liquid sealing element and a cooperating gas sealing component positioned around the polished rod. The liquid sealing element is attached to the well tubing and includes a plurality of liquid seals configured to allow a desired quantity of crude oil to leak past the seals to the polished rod to lubricate and cool the polished rod. The liquid sealing element also centers the polished rod within the well tubing. The gas sealing component is preferably removably secured to the liquid sealing element by a sealing adapter. A plurality of gas seals is provided at the uppermost end of the gas sealing component and is covered by a protective seal. The gas sealing component includes a liquid/gas separation chamber which receives the well gas required to perform the gas sealing function and which discharges excess well gas and crude oil into the well production line. A compressor is provided to pump gas from the well casing to the gas sealing component liquid/gas separation chamber. A liquid level sensor and automatically actuated switch cooperate to shut down the pump motor in the event the liquid level rises above safe limits.

Additional objects and advantages of the present invention will be apparent from the following description, claims and drawings.

DESCRIPTION OF THE PREFERRED EMBODIMENTS

The leakage and spillage of liquids, particularly crude oil, from hydrocarbon-producing wells can pose both environmental and equipment operation problems. The leakage of a sufficient amount of crude oil can easily contaminate the environment surrounding the well and have adverse effects on plant and animal life. If the well is near a populated area, leaked crude oil, especially crude oil under pressure, could be sprayed over a wide area, causing atmospheric and ground pollution and property damage which must be cleaned up and repaired. The leakage of even small quantities of oil into the ground could contaminate ground water and possibly drinking water supplies. If a leak is found right after it has started, the repair of the well sealing structures can usually be accomplished relatively quickly and any environmental contamination by crude oil minimized. However, because many oil wells are widely scattered in remote locations and are operated and monitored by a single operator, the operator does not always get to a well soon enough to avert major problems.

The present invention provides a sealing system for a hydrocarbon well which prevents the leakage and spillage of hydrocarbon liquid, in particular crude oil. Moreover, this system functions substantially automatically to return otherwise contaminating hydrocarbon liquid or crude oil to the well production line. Consequently, the present sealing system is especially well suited for use in oil fields where constant operator attention is not available.

The term "hydrocarbon-producing well" as used herein is used to refer to a well that produces both hydrocarbon liquids, namely crude oil, and the hydrocarbon gases that are typically found in such wells. The term "oil well" is used interchangeably with "hydrocarbon-producing well" to mean the same thing.

Figure 1:
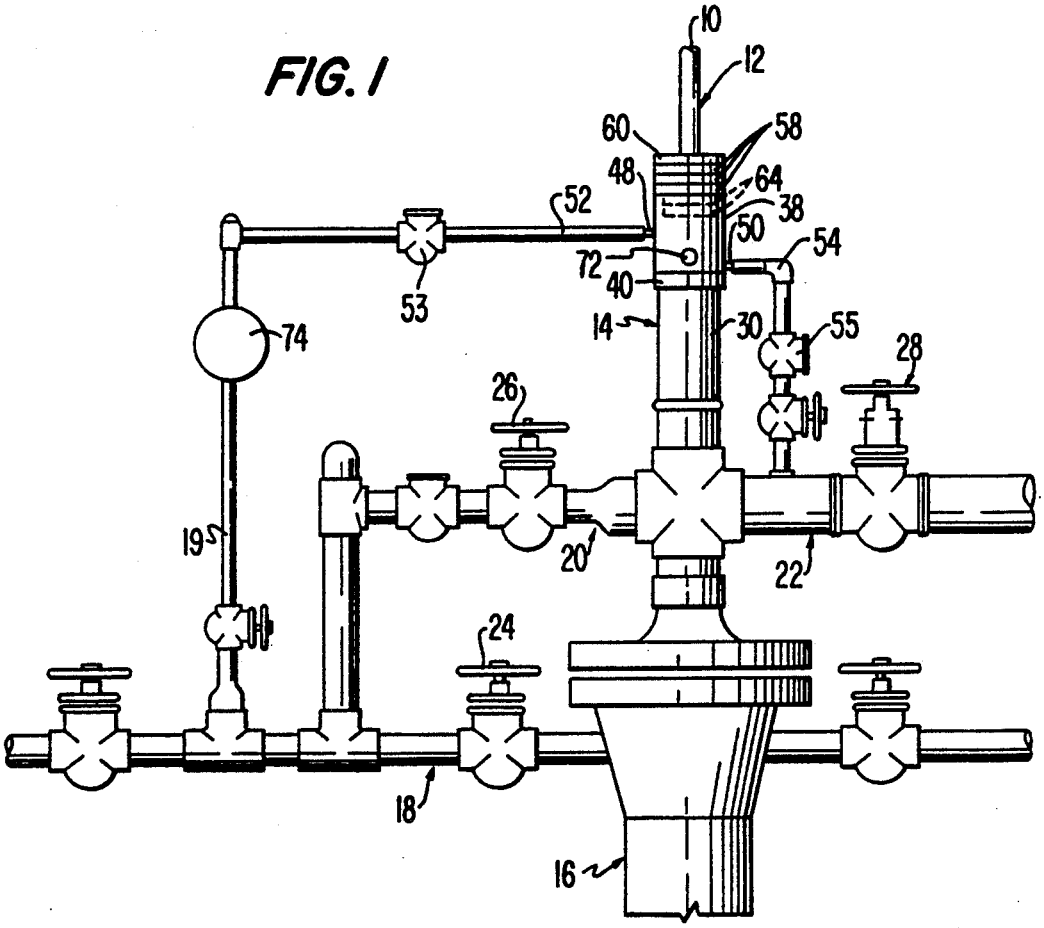
FIG. 1 illustrates a portion of a hydrocarbon-producing well pumping apparatus including the sealing system of the present invention.

Referring to the drawings, FIG. 1 illustrates a portion of a hydrocarbon-producing well pumping apparatus that includes the sealing system of the present invention. The upper end 10 of the well polished rod 12 is shown extending from the sealing system 14, which will be described in detail hereinbelow. The sealing system 14 is positioned above the well tubing 16, which extends downwardly into the ground in a well casing (not shown) to a hydrocarbon deposit which contains crude oil. Various conduits, 18, 20 and 22 for example, and valves, 24, 26 and 28 for example, are provided to permit the flow of well fluids from the well to storage tanks or other storage facilities.

Figure 2:
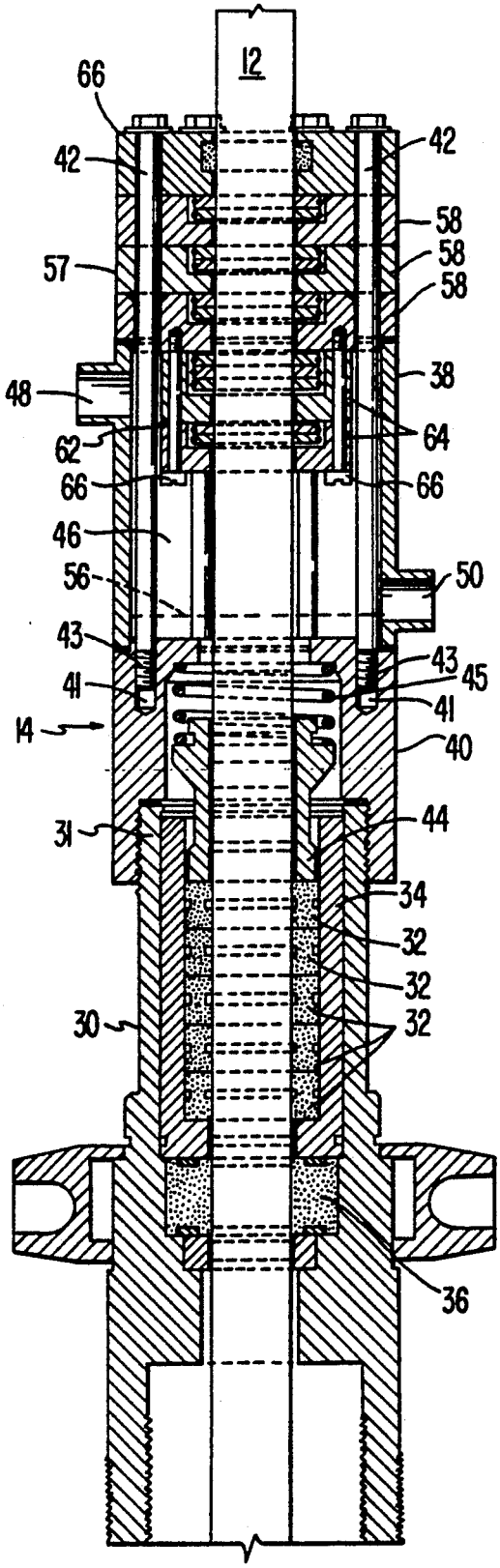
FIG. 2 is a cross-sectional view of the hydrocarbon-producing well sealing system of the present invention.

FIG. 2 illustrates the sealing system 14 of the present invention in cross-section. The present sealing system has two primary components. The first component is a liquid sealing element 30 of the kind conventionally used to seal a polished rod against the leakage of crude oil from the well. Liquid sealing element 30 preferably includes several sealing rings 32 around the polished rod 12. The sealing rings 32 are held in place around the polished rod by a sleeve 34. A seal 36 is used only when the well is stopped for maintenance. The sealing rings 32 are configured to permit a controlled amount of oil to leak past the polished rod 12 to lubricate the polished rod as it reciprocates axially within the well. Many available polished rod sealing systems are sealed only by a sealing arrangement similar to liquid sealing element 30. However, such an arrangement by itself will develop oil leaks and spills in the absence of constant operator attendance.

To prevent such leaks and spills, the present sealing system also includes a gas sealing component 38. The gas sealing component 38 is attached to the liquid sealing element 30 in a manner that preferably creates a substantially liquid and air tight seal between the two polished rod sealing components. One structure found to be effective is the sealing adapter 40 shown in FIG. 2. The sealing adapter 40 is preferably threaded onto the upper end 31 of the liquid sealing element 30. The gas sealing component is secured to the adapter 40 by several circumferentially spaced bolts 42, two of which can be clearly seen in FIG. 2. Threaded recesses 41 are provided in adapter 40 to receive the threaded ends 43 of the bolts 42. The sealing adapter 40 is preferably removably attached between the liquid sealing element 30 and the gas sealing component 38 to provide access to the interior of the sealing system so that the sealing elements can be changed when necessary. The sealing adapter 40 further includes a spring biased pressure element 44 that is held in contact with the seals 32 by a spring 45 to press the seals against the bottom of the sleeve 34.

The gas sealing component 38 includes a liquid/gas separation chamber 46. The liquid/gas separation chamber 46 includes an inlet 48 and an outlet 50. The inlet 48 and outlet 50 are fluidically connected with conduits 52 and 54, respectively (FIG. 1).

The liquid/gas separation chamber 46 is sealed above the inlet 48 by a gas sealing assembly 57 which includes several gas seal elements 58. The gas sealing elements 58 are preferably formed from pressure packing rings of the kind used to seal gas in reciprocating compressors and have the composite construction shown. However, other kinds of sealing elements able to maintain a reliable seal under pressure in the presence of the continuous reciprocating movement of a structure like an oil well polished rod could also be used. A dust seal 60 is provided on top of the outermost gas seal 58 to protect the gas sealing assembly 57 from dust, dirt and the like.

The arrangement of the liquid seals 32 in the liquid sealing element 30 allows a controlled amount of oil to reach the polished rod to lubricate it and cool it. An oil wiper ring assembly 62 is provided around the polished rod 12 at the bottom of the gas sealing assembly 57 to keep the crude oil from reaching the gas seals 58. Two oil wiper rings 64 are shown secured to the lowermost gas seal 58 by bolts 66. This method of attachment insures the easy removal of the oil wiper rings when their replacement is required.

The entire gas sealing component 38 is removably attached to the sealing adapter 40 by the threaded bolts 42. This method of attachment facilitates the removal of the sealing assembly 57 and the replacement of the gas seals 58 or the oil wiper rings 64 when necessary.

Figure 4:
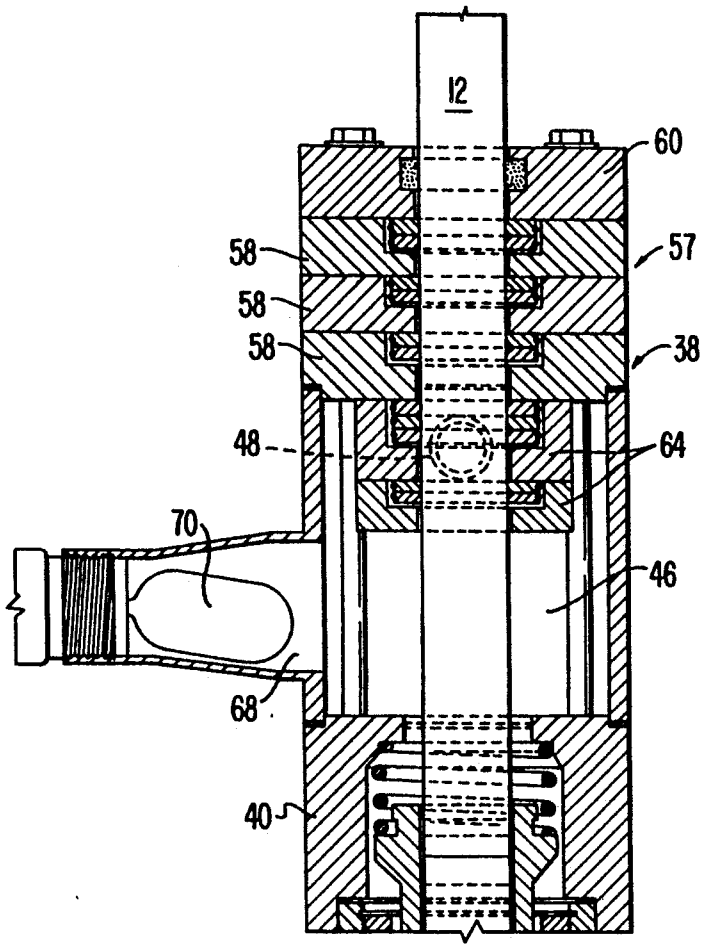
FIG. 4 is a side cross-sectional view of the gas sealing component of the hydrocarbon well sealing system of FIG. 3, viewed from a different side.
Figure 3:
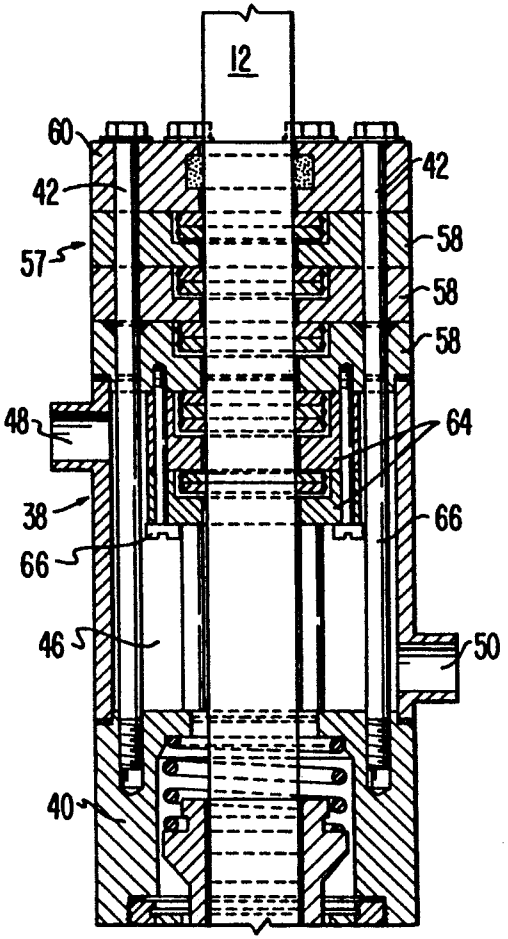
FIG. 3 is a side cross-sectional view of the gas sealing component of the hydrocarbon-producing well sealing system of the present invention.

FIGS. 3 and 4 illustrate the upper portion of the sealing adapter 40 and the gas sealing component 38 of the present sealing system in two different cross-sectional views. The FIG. 3 view is substantially the same as that shown in FIG. 2. FIG. 4 shows, in addition, a chamber 68 to hold a liquid level sensor 70 which activates a microswitch 72 to stop the well motor (not shown) in the event a large hydrocarbon liquid leak occurs which causes crude oil to rise above the liquid drain or above the normal liquid level 56.

The sealing system of the present invention additionally includes a compressor 74. Compressor 74 is fluidically connected to the inlet 48 of the gas sealing component 38 through conduit 52 and pressurizes the well gas delivered to the chamber 46 to just above the pressure of the well discharge line. This pressure is contained by the gas seal assembly 57. The specific pressure of the gas supplied to chamber 46 will depend on the operating conditions and physical characteristics of each well.

The hydrocarbon well sealing system of the present invention employs gas sealing principles to prevent and contain crude oil leakage from operating hydrocarbon-producing wells. The conventional liquid sealing elements employed in the past form a part of the present sealing system. However, the liquid sealing element 30 employed herein is used for an additional purpose as well. The liquid sealing element 30 is not intended to prevent completely the leakage of hydrocarbon liquid past the well polished rod. Rather, the liquid seals 32 are designed to allow a controlled amount of leakage of oil from the well around the polished rod 12 to lubricate and cool the polished rod 12 during well operation. The liquid sealing element 30 additionally functions to center the polished rod 12 and to insure its axial alignment during operation of the well.

The gas sealing component 38 of the present sealing system functions in concert with the components described above to effectively prevent the leakage of crude oil from a hydrocarbon-producing well. The liquid/gas separation chamber 46 shown and described in connection with FIGS. 2, 3 and 4 is instrumental in achieving this result. Gas from the well casing is pumped into conduits 18 and 19 by the compressor 74 and from compressor 74 through conduit 52 and into chamber 46 through inlet 48. A check valve 53 is provided in conduit 52 between the compressor 74 and the liquid/gas separation chamber inlet 48 to prevent the gas flow from reversing direction. Sufficient gas is supplied to chamber 46 by the compressor 74 at a pressure which maintains the required sealing pressure on the gas seals 58 and to keep the liquid level at or below the level of line 56 (FIG. 2).

Any excess gas is returned to the well production line from chamber 46 through the outlet 50 and into conduit 54. Conduit 54 includes at least one check valve 55 so that fluid flow from the chamber cannot reverse direction. Conduit 54 is fluidically connected to the well production line so that the well gas used to seal the gas seals 58 can be returned to the well production line, where it is available for recovery or reuse. The use of well gas from the well casing to perform the sealing function as described lowers the casing pressure of the well and, as a result, can substantially increase the hydrocarbon liquid production of the well. An additional advantage of using a gas seal as described herein will be evident when the gas seals 58 wear, which will eventually happen. Instead of leaking potentially noxious and environmentally contaminating crude oil as the currently available seals do, small quantities of relatively harmless natural gas will be leaked around the sealing assembly of the present invention.

In the event of the failure of the liquid seal element 30 or other circumstances which cause hydrocarbon liquid or crude oil to enter the chamber 46 and rise above the level of line 56, the liquid level sensor 70 activates a liquid level microswitch 72 (FIG. 1) to stop the well motor. Consequently, crude oil is effectively precluded from spilling or leaking beyond the well sealing structures. In addition, an oil well using the sealing system of the present invention does not require the constant monitoring by operating personnel currently required by available sealing structures because the present sealing system automatically detects excess crude oil in chamber 46 and shuts down.

The present invention has been described with respect to preferred embodiments. However, alternatives, modifications and variations of the foregoing preferred embodiment of the present invention that fall within the scope and spirit of the appended claims may be apparent to those skilled in the art and are intended to be covered by the appended claims.

INDUSTRIAL APPLICABILITY

The sealing system of the present invention will find its primary applicability in the sealing of hydrocarbon-producing wells to prevent contaminating leaks and spills of crude oil. However, the present sealing system may also be adapted to provide an effective seal for other types of pumping apparatus and operations which involve the production of a gas component and a liquid component.

I claim:

1. A sealing system for a hydrocarbon-producing well including a motor driven pump connected through a plurality of sucker rods to a polished rod driven by the motor to reciprocate axially within a well tubing to pump liquid and gas hydrocarbons from a hydrocarbon deposit through a production line to a storage facility, wherein said sealing system includes:

(a) dual function liquid sealing means for centering the polished rod and for preventing the passage of all but a controlled amount of liquid hydrocarbon;

(b) liquid/gas separation means located above said liquid sealing means for maintaining liquid hydrocarbon separate from gas hydrocarbon, said separation means including discharge means for directing excess gas and liquid hydrocarbons to the well production line;

(c) gas seal means located around said polished rod above said liquid/gas separation means for preventing the passage of hydrocarbon gases from the well to the atmosphere; and (d) compressor means for directing a supply of pressurized hydrocarbon gas from the well to the gas seal means to seal the well.

2. The hydrocarbon-producing well sealing system described in claim 1, wherein said liquid/gas separation means includes chamber means for receiving said pressurized gas and for discharging excess liquid and gas hydrocarbons as required to prevent the undesired leakage of liquid hydrocarbons from the well.

3. The hydrocarbon-producing well sealing system described in claim 2, wherein said chamber means includes gas and liquid discharge means fluidically connected with said well production line for directing excess gas and liquid to said production line.

4. The hydrocarbon-producing well sealing system described in claim 3, wherein said chamber means further includes wiper means for preventing liquid hydrocarbon from contacting said gas seal means.

5. The hydrocarbon-producing well sealing system described in claim 3, wherein said chamber means further includes motor deactivation means for shutting down said motor if liquid hydrocarbon exceeds a maximum level in said chamber.

6. The hydrocarbon-producing well sealing system described in claim 1, wherein said sealing system further includes seal adapter means for removably attaching said gas seal means and said liquid/gas separation means to said liquid sealing means.

7. The hydrocarbon-producing well sealing system described in claim 4, wherein said wiper means comprises at least two liquid seal elements positioned about the circumference of said polished rod and removably secured to said gas seal means.

8. The hydrocarbon well-producing sealing system described in claim 1, wherein said gas seal means comprises a plurality of stacked sealing elements capable of withstanding a predetermined sealing pressure.

9. A spillproof oil well sealing system which effectively seals an operating oil well which includes a motor driven reciprocating polished rod to prevent the leakage and spillage of crude oil from the well to the surrounding environment, said sealing system including:

(a) liquid sealing element means for containing crude oil in the well below the location of the liquid sealing element means; and (b) gas sealing component means for enhancing the sealing capability of the liquid sealing element means to contain crude oil in the well, wherein said gas sealing component means includes gas seal element means for preventing the passage of crude oil therethrough, chamber means for receiving gas from said well to act on said gas seal element means, and discharge outlet means for directing crude oil in said chamber means in excess of a predetermined maximum level back to the well before said oil can be discharged into the well environment.

10. The sealing system described in claim 9, wherein said liquid sealing element means includes a plurality of seals positioned about the polished rod and configured to permit sufficient oil to reach the polished rod to lubricate and cool the polished rod.

11. The sealing system described in claim 10, wherein said chamber means includes inlet means for directing gas from said well into said chamber means and said inlet means is fluidically connected to compressor means for pressurizing the gas directed into said chamber means.

12. The sealing system described in claim 11, further including oil wiper means positioned about said polished rod adjacent to said gas seal element means for preventing oil on said polished rod from contacting said gas seal element means.

13. The sealing system described in claim 12, wherein said chamber means further includes oil level sensing means for detecting the level of crude oil in said chamber means and motor shut down means for stopping the operation of said motor when the level of crude oil in said chamber means is detected to exceed a predetermined maximum level.

14. The sealing system described in claim 13, further including dust seal means for protecting said gas seal element means from environmental contamination.

15. The sealing system described in claim 11, wherein said gas sealing component means is removably attached to said liquid sealing element means through adapter means for providing a sealing connection between said gas sealing component means and said liquid sealing element means.

* * * * *